US005198831A

United States Patent [19]

Burrell et al.

[11] Patent Number: 5,198,831

[45] Date of Patent: Mar. 30, 1993

[54] PERSONAL POSITIONING SATELLITE NAVIGATOR WITH PRINTED QUADRIFILAR HELICAL ANTENNA

[75] Inventors: Gary L. Burrell, Olathe; Min H. Kao, Lenexa; Paul K. Shumaker, Olathe, all of Kans.

[73] Assignee: 501 Pronav International, Inc., Lenexa, Kans.

[21] Appl. No.: 588,358

[22] Filed: Sep. 26, 1990

[51] Int. Cl.[5] ..... H01Q 1/360; H01Q 11/080; H01Q 23/000

[52] U.S. Cl. ..... 343/895; 343/701; 343/850

[58] Field of Search ..... 343/895, 792.5, 700 MS, 343/701, 850

[56] References Cited

U.S. PATENT DOCUMENTS

| | | | |
|---|---|---|---|
| 3,523,251 | 8/1970 | Halstead | 343/895 |
| 4,148,030 | 4/1979 | Foldes | 343/895 |
| 4,349,824 | 9/1982 | Harris | 343/895 |
| 4,554,554 | 11/1985 | Oleson et al. | 343/895 |
| 4,970,523 | 11/1990 | Braisted et al. | 342/418 |
| 5,134,422 | 7/1992 | Auriol | 343/895 |

FOREIGN PATENT DOCUMENTS

| | | | |
|---|---|---|---|
| 0320404 | 6/1989 | European Pat. Off. . | |
| 0099006 | 6/1982 | Japan | 343/895 |

OTHER PUBLICATIONS

Bricker et al., S-Band Resonant Quadrifilar Antenna For Satellite Communcations, RCA Engineer, 1974, pp. 70–73.

Lohse, V. K., Eine Antenne f/e,uml/u/ r alle Wetter, Funkschau 23/1989, pp. 57–59.

Magellan Advertisement entitled "Magellan Hits the Mark With Affordable GPS Positioning"; Magellan Systems Corporation, Monrovia, Calif. 91016, 2 pages.

Megellan Advertisement entitled "Megellan Puts GPS In Your Grasp"; Megellan Systems Corporation, Monrovia, Calif. 91016, 2 pages.

Trimble Navigation Advertisement entitled"TransPak GPS Hand-held GPS Receiver"; Trimble Navigation, Sunnyvale, Calif. 94088, 2 pages.

Trimble Navigation Advertisement entitled "10X Navigator LORAN/GPS Navigation System"; Trimble Navigation, Sunnyvale, Calif. 94088, 2 pages.

Trimble Navigation Advertisement entitled "Nav-Graphic II GPS/LORAN Navigation System"; Trimble Navigation, Sunnyvale, Calif. 94038, 2 pages.

Marinetek Advertisement entitled "Marinetek SeaFix GP7"; Marinetek; San Jose, Calif. 95131, 4 pages.

Shipmate Advertisement entitled "RS5300 GPS Satellite Navigator Continuously Provides An Accurate Position Anywhere On Earth Regardless Of Weather Conditions"; Robertson-Shipmate, Inc., Hauppauge, N.Y. 11788, 2 pages.

Koden Advertisement entitled "GPS Navigator KGP-900"; Koden International Incorporated, Norwell, Mass. 02061, 2 pages.

Magnavox Advertisement entitled "Magnavox MX5400 GPS Navigator"; Magnavox, Torrance, Calif. 90503, 2 pages.

Navstar Advertisement entitled "Navstar GPS-XR4"; Navstar, 1 page.

Magnavox Advertisement entitled "MX4102 Transit Navigator & MX 4200 GPS Receiver"; Magnavox, Torrance, Calif. 90503, 4 pages.

Magellan Advertisement entitled "Megellan Puts Affordable GPS Technology At Your Fingertips"; Magellan, Monrovia, Calif. 91016, 1 page.

Sony Advertisement entitled "Sony GPS", 1 page Jan. 30, 1990.

Micrologic Advertisement entitled "Micrologic Explorer GPS"; Micrologic; Chatsworth, Calif. 91311, 1 page.

*Primary Examiner*—Rolf Hille

*Assistant Examiner*—Peter Toby Brown

*Attorney, Agent, or Firm*—Hovey, Williams, Timmons & Collins

[57] ABSTRACT

A navigation unit (10) for receiving navigation signals from a source thereof such as global positioning satellites is configured to rack mount and connect with a remote fixed antenna and for detached, self-powered operation using a directly mounted helical antenna (14). The preferred antenna (14) includes antenna elements composed of a thin film of conductive material (50) printed on a flexible dielectric substrate (44) rolled into a tubular configuration.

8 Claims, 6 Drawing Sheets

PERSONAL POSITIONING SATELLITE NAVIGATOR WITH PRINTED QUADRIFILAR HELICAL ANTENNA

BACKGROUND OF THE INVENTION

1. Field of the Invention

The present invention is concerned with a navigation unit for receiving navigation signals from a source thereof such as global positioning satellites. More particularly, the preferred navigation unit is configured to rack mount in order to connect with a remote, fixed antenna, and also configured for detached, battery-powered operation using a directly mounted helical antenna. The preferred antenna includes four antenna filaments composed of a thin film of conductive material printed on a flexible dielectric substrate rolled into a tubular shape in order to present the antenna elements in a helical configuration.

2. Description of the Prior Art

The prior art discloses navigation units operable for receiving navigation signals such as those from global positioning satellites. Known prior art units include those which can be permanently mounted to a vehicle for connection to a remote fixed antenna, and include hand-held units which can be transported by a user.

The hand-held units include an attached antenna which must be held erect during the time required to receive and process the navigation signals. Receipt and processing of the navigation signals can take a period of minutes and holding the erect for the required time can become tedious. Accordingly, the prior art points the need for an economically manufactured navigation unit which can be both rack mounted to a vehicle, and which can be conveniently detached for personal use away from the vehicle without the need for precise, steady, and vertical alignment of the antenna.

SUMMARY OF THE INVENTION

The present invention solves the prior art problems discussed above and provides a distinct advance in the state of the art. That is to say, the navigator hereof can be rack mounted in a vehicle or detached for personal use using an antenna which need not be precisely aligned with vertical.

Broadly speaking, the navigator hereof includes a battery-powered navigation signal processing unit, a plug-in connector for coupling with a remote, fixed, vehicle antenna when mounted to the vehicle, and a directly mounted antenna for signal receipt during personal use away from a vehicle.

The preferred antenna includes a plurality of antenna elements composed of a thin film of conductive material printed on a flexible substrate which is rolled to form a tubular member. The antenna elements are arranged to present a helical configuration on the tubular member. More particularly, the preferred antenna also includes a preamplifier with some of the electrical components formed on the flexible substrate from thin films of conductive material. Other preferred aspects of the preferred navigator are discussed further hereinbelow.

DESCRIPTION OF THE PREFERRED EMBODIMENT

Figure 1:
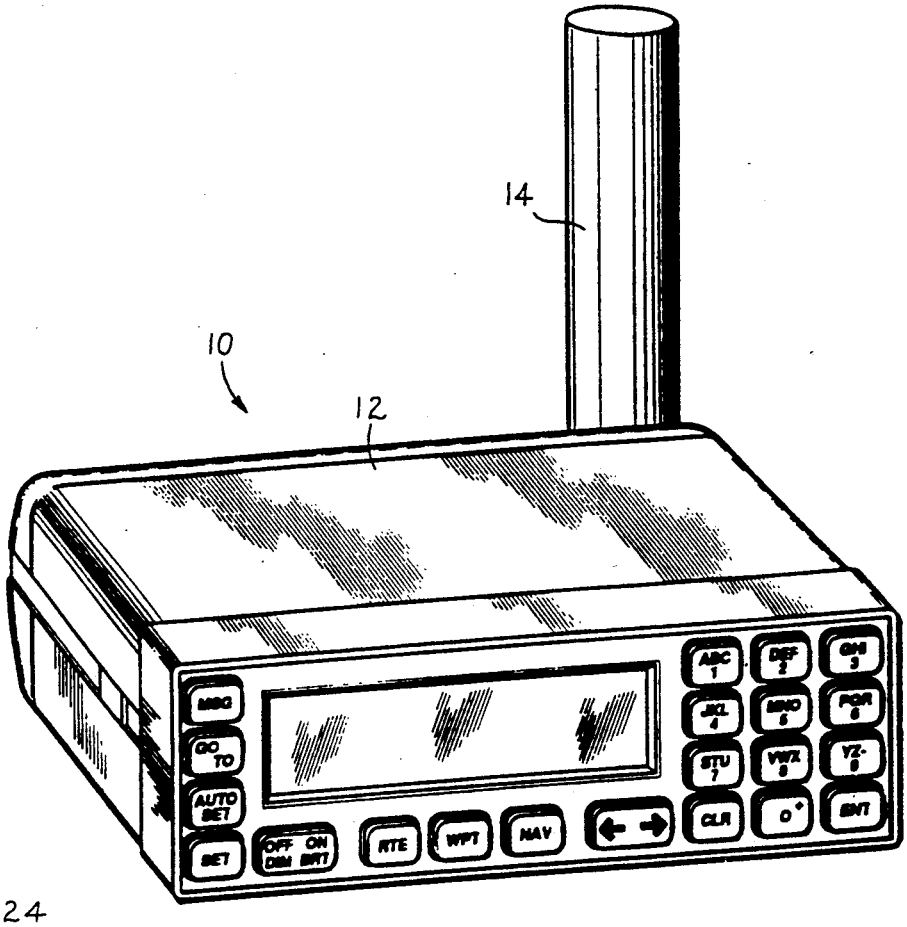
FIG. 1 is a perspective view of the preferred navigator shown in the personal use mode with the antenna in the upright position.
Figure 4:
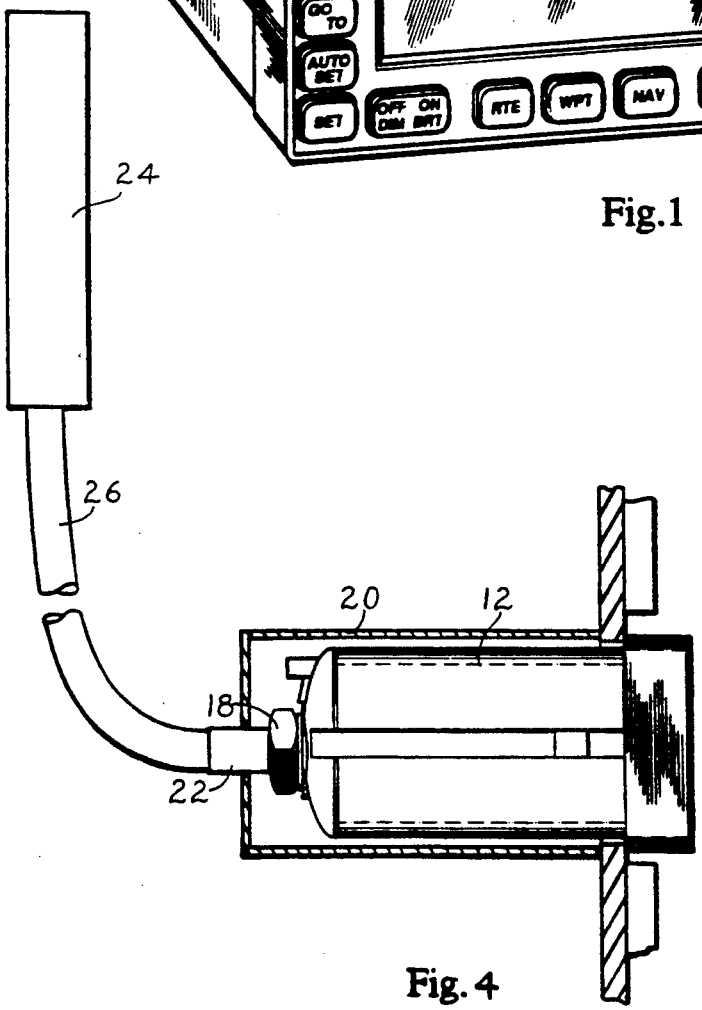
FIG. 4 is a left side elevational view of the navigator in the vehicle-attached mode showing a mounting rack in section and illustrating connection with a remote antenna.
Figure 2:
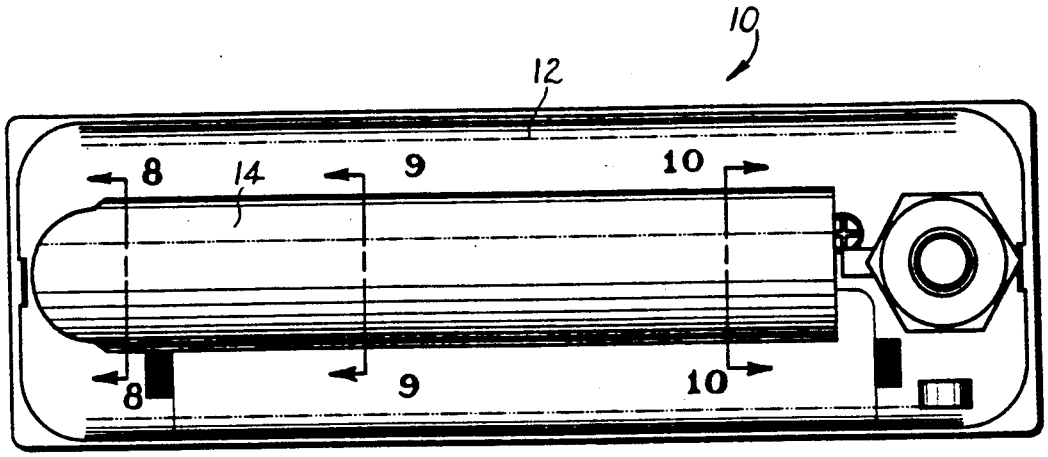
FIG. 2 is a rear elevational view of the navigator with the personal-use antenna rotated to the storage position.
Figure 3:
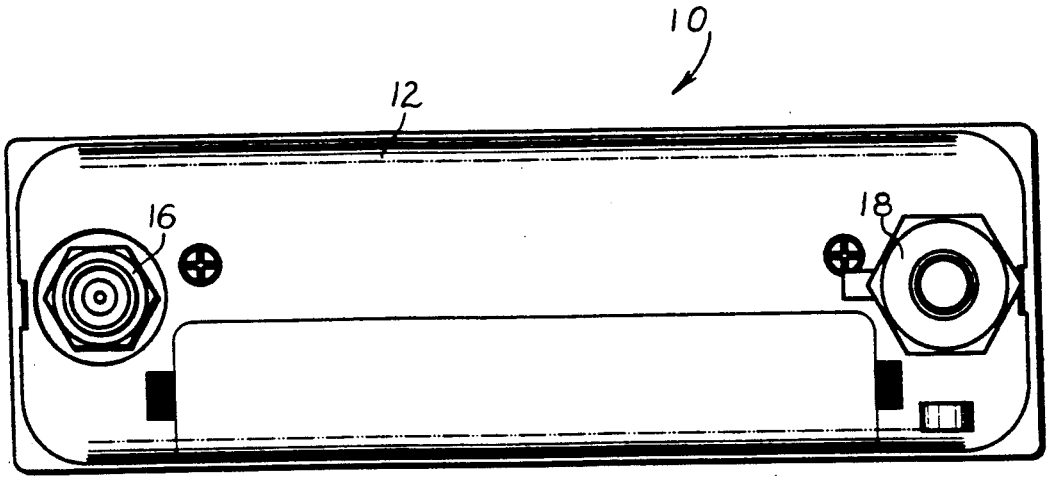
FIG. 3 is a rear elevational view of the navigator shown in the vehicle mounting mode without the personal-use antenna.

FIGS. 1 and 2 illustrate the preferred navigator 10 in the personal-use mode. Navigator 10 broadly includes signal processing unit 12 produced by Garmen International Inc. of Lenexa, Kans. and personal-use antenna 14 shown in the upright position in FIG. 1, and shown rotated to a storage position in FIG. 2. FIGS. 3 and 4 illustrate navigator 10 in the vehicle mounting mode.

Processing unit 12 includes personal-use antenna connector 16 and remote antenna connector 18 both of conventional design. As shown in FIG. 4, signal processing unit 12 is designed to slide into a rack 20 having a remote antenna connector receptacle 22 coupled through the back wall of rack 20. Receptacle 22 is connected to remote antenna 24 by way of coaxial cable 26. With this arrangement, processing unit 12 can slide into rack 20 so that connector 18 is aligned with and plugs directly into receptacle 22. This eliminates the need for manual connection required in the prior art. Similarly, signal processing unit 12 can be easily removed from rack 20 with connector 18 and receptacle 22 becoming uncoupled as unit 12 is removed.

After removal from rack 20, antenna 14 is conveniently connected to connector 16 to place navigator 10 in the personal-use mode. Advantageously, a shoulder slung bag can be provided for carrying navigator 10 until needed for use. When needed, navigator 10 is removed from the carrying bag and antenna 14 coupled to connector 16 and then rotated to the upright position for signal reception. When use is complete, antenna 14 can be rotated to the storage position and navigator 10 replaced in the carrying bag. In the alternative, the carrying bag can be provided with an appropriately located opening so that antenna 14 can be rotated between the upright and storage positions without removal of navigator 10 from the carrying bag.

As those skilled in the art will appreciate, the ability to place navigator 10 in either the vehicle mounted or personal-use mode greatly enhances navigation capabilities. That is to say, with the unique design of navigator 10, it is no longer necessary to purchase separate vehicle mounted and hand-held navigators but rather, navigator 10 can be used in either mode. Additionally, as explained further hereinbelow, antenna 14 is designed for signal reception sensitivity about 15 degrees below horizontal which means that navigator 10 need not be held perfectly upright during personal use.

Figures 7, 8, 9, 10:
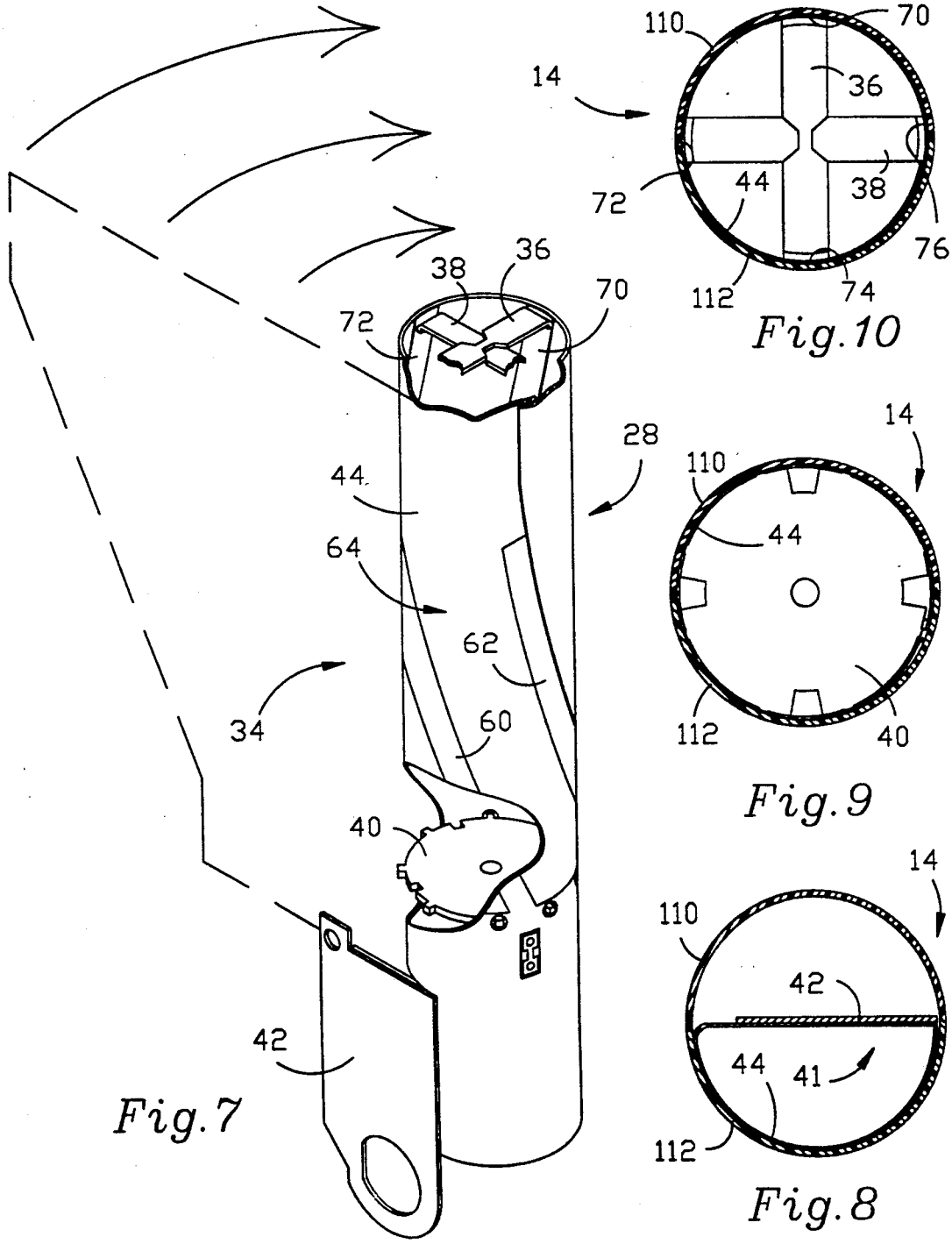
FIG. 7 is an exploded view of a portion of the internal components of the personal-use antenna illustrating formation of the substrate into a tubular configuration.
FIG. 8 is a sectional view taken along line 8—8 of FIG. 2.
FIG. 9 is a sectional view taken along line 9—9 of FIG. 2.
FIG. 10 is a sectional view taken along line 10—10 of FIG. 2.
Figure 11:
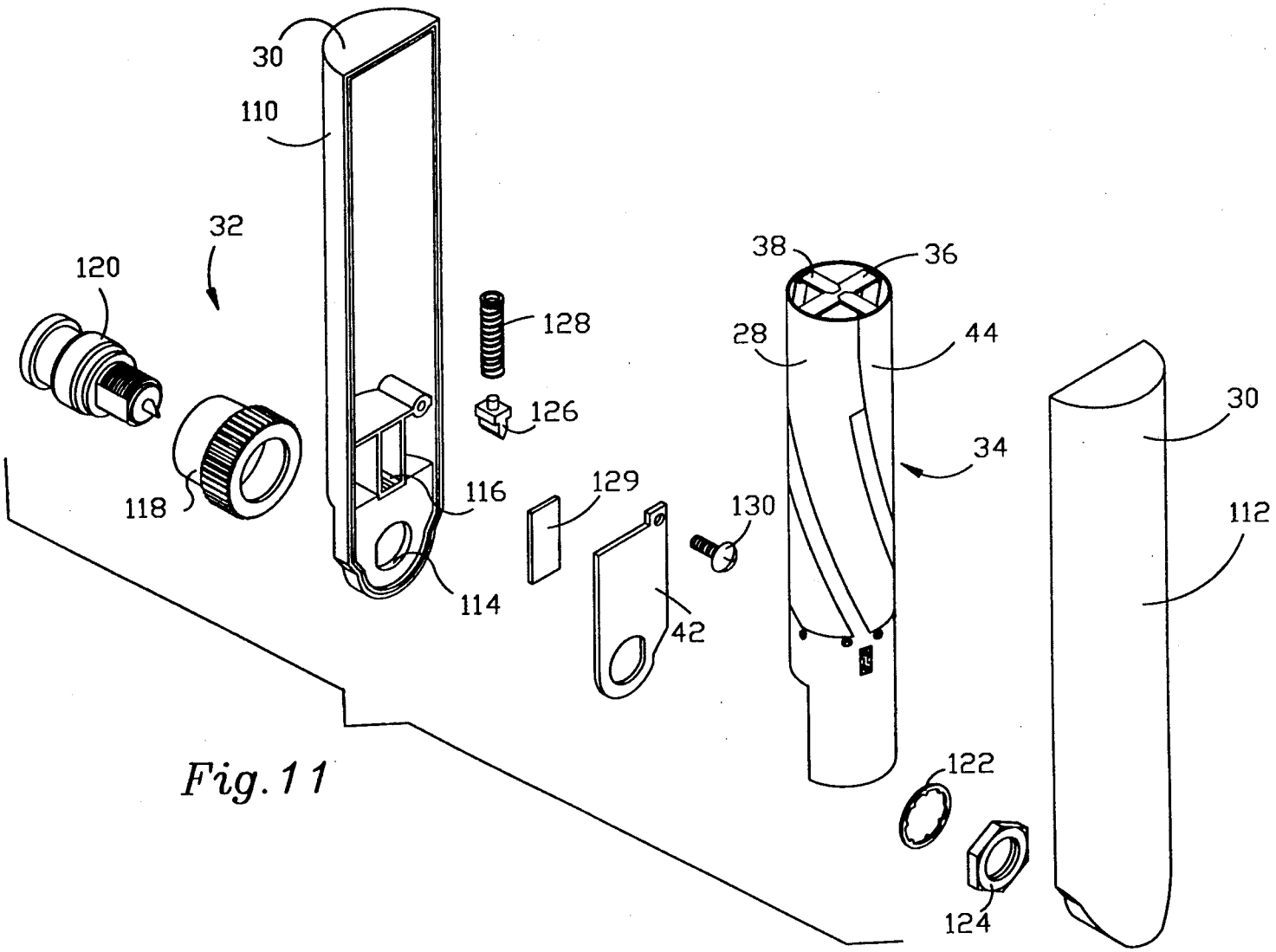
FIG. 11 is an exploded view of the components of the personal-use antenna.

FIGS. 5–12 illustrate personal-use antenna 14 which includes signal receiving assembly 28, housing 30, and connector assembly 32 (FIGS. 7 and 11). Signal receiving assembly 28 includes antenna body 34, crossover arms 36, 38, support disk 40, preamplifier 41, and preamplifier backing and support plate 42.

Figure 5:
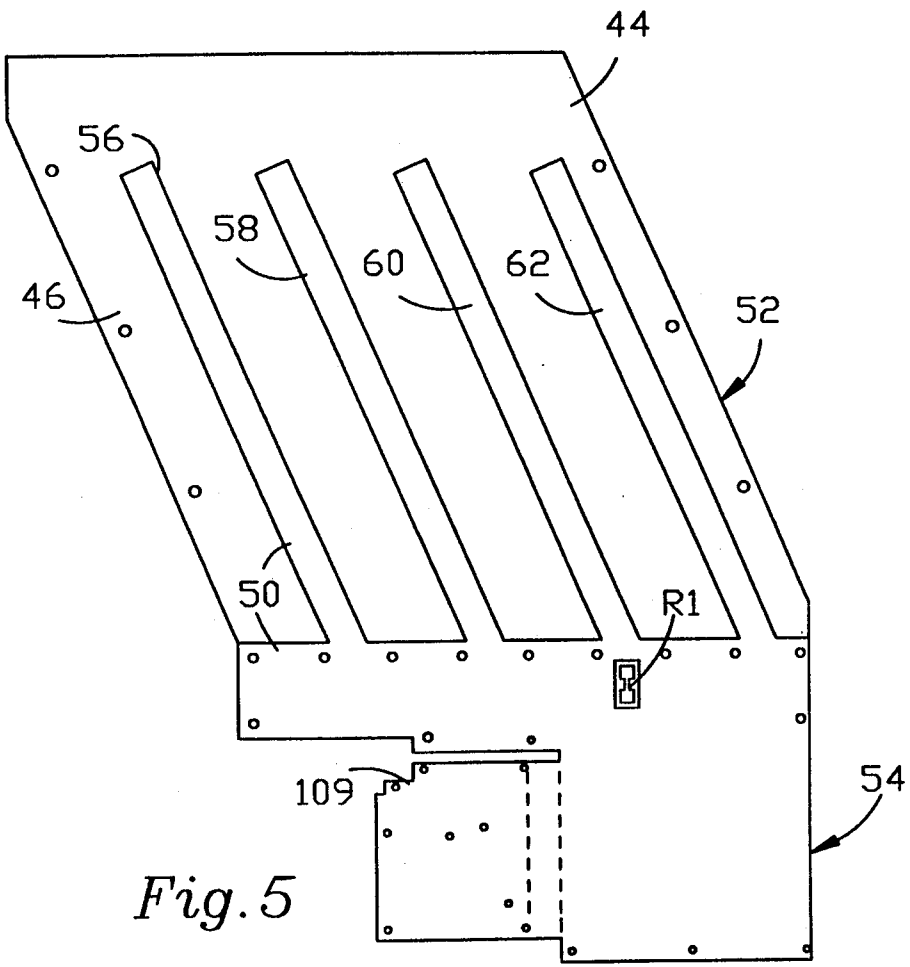
FIG. 5 is a plan view of the outboard face of the substrate member of the personal-use antenna showing the printed lower antenna elements thereon.
Figure 6:
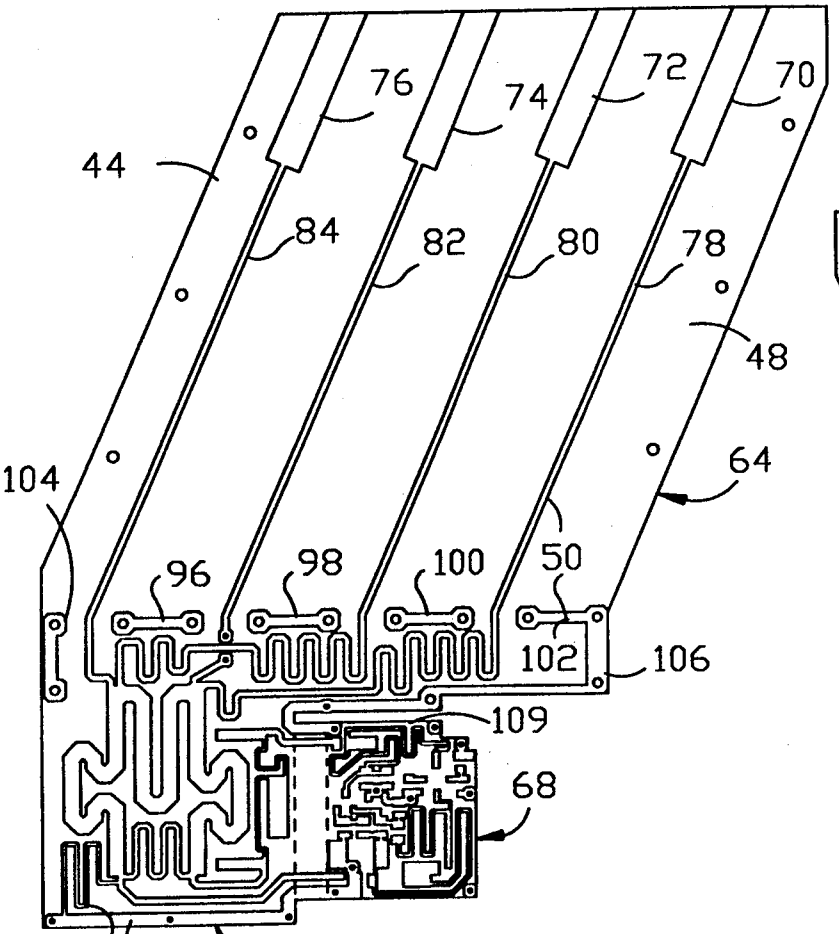
FIG. 6 is a plan view of the inboard face of the substrate member of FIG. 5 showing printed upper antenna elements and printed preamplifier components and circuit connections.

Antenna body 34 includes dielectric substrate 44 composed of 0.010 inch thick TEFLON presenting outboard face 46 and inboard face 48, and further includes printed conductor material 50. As illustrated in FIGS. 5 and 6, substrate 44 is configured initially as a flat sheet with conductor material 50 printed on faces 46 and 48 thereof using conventional printed circuit board techniques. More particularly, conductor material 50 is illustrated in solid black in FIGS. 5 and 6 and is composed of one-half ounce per square inch rolled copper with is "pre-tinned" to minimize oxidization and allow soldering of components thereto.

Turning now to FIG. 5, substrate outboard face 46 presents lower antenna section 52 and shield section 54. In antenna section 52, conductor material 50 is configured as shown to present four elongated lower antenna elements 56, 58, 60, and 62. As illustrated, lower elements 56–62 do not extend to the upper edge of face 46 but are instead spaced therefrom. In shield section 54, conductor material 50 covers substantially all of this section in order to present an electromagnetic shield for the opposed portion of inboard face 48.

Inboard face 48 (FIG. 6) includes upper antenna section 64, signal filter section 66, and preamplifier section 68. In upper antenna section 64, conductor material 50 is configured to present four upper antenna elements 70, 72, 74, and 76 as shown which correspond to face-opposed lower elements 56–62 respectively. More particularly, with reference to both FIGS. 5 and 6, upper elements 70–76 extend downwardly from the upper edge of face 48 a distance equal to spacing of lower elements 56–62 from the upper edge of face 46. In this way, the lower ends of upper elements 70–76 are capacitively coupled with the upper ends of lower elements 56–62 in order to form part of the antenna resonance loop along with crossover arms 36, 38.

In signal filter section 66, conductor material 50 is configured as shown to form a 180 degree delay line and a low pass filter as explained further hereinbelow in connection with preamplifier 41 illustrated in FIG. 12. The conductors printed on preamplifier section 68 are configured to form inductors included as part of preamplifier 41 and to form a printed circuit board for the remaining components of preamplifier 41 (FIG. 12).

Figure 12:
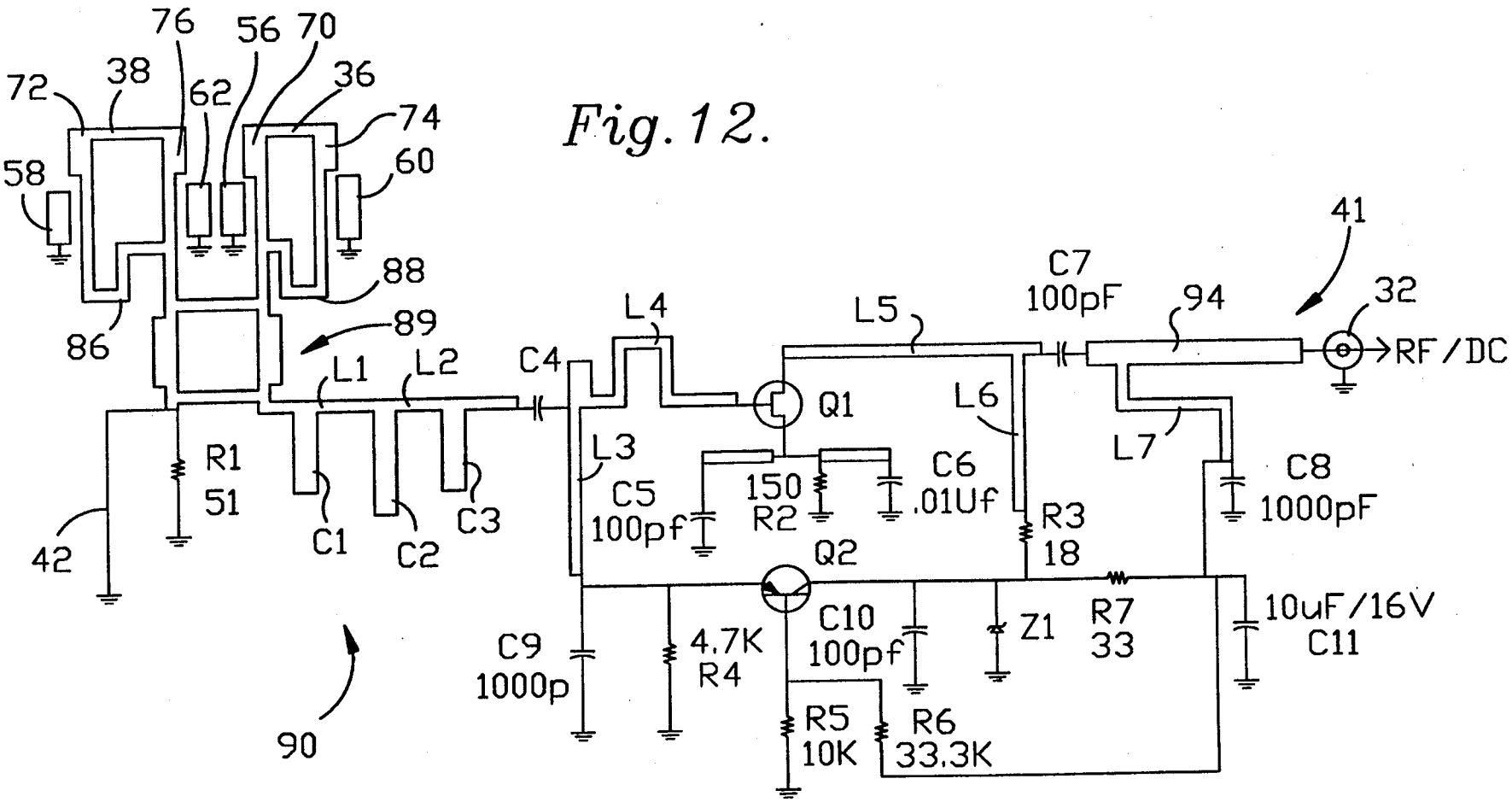
FIG. 12 is an electrical schematic representation of the antenna elements and preamplifier of the personal-use antenna.

FIG. 12 is a schematic diagram of the signal handling components of antenna 14 with conductor material 50 schematically illustrated by the heavy black lines. As illustrated, the lower ends of lower antenna elements 56–62 are connected to the conductors of shield section 54 at ground potential. Crossover arm 38 interconnects the upper ends of upper antenna elements 72 and 76, and crossover arm 36 interconnects the upper ends of upper elements 70 and 74.

As discussed above, the upper ends of lower antenna elements 56–62 are capacitively coupled with the lower ends of upper antenna elements 70–76 through dielectric substrate 44 at feed points 78, 80, 82, and 84 respectively (FIG. 6). With this capacitive coupling, antenna feed is accomplished at the 50 ohm point in the antenna resonance loop. The thickness of substrate 44 provides a 0.010 inch gap between the antenna at feed points 78–84. Signal feed at these coupling points is particularly advantageous for reception of signals at global positioning satellite frequencies of 1575.42 megahertz. That is to say, these feed points are at the 50 ohm matched impedance in the antenna resonance loop and result in relatively high signal voltage at substantially zero mismatch.

With reference to FIG. 12, the preferred component values are shown in the drawing figure. Additionally, the components formed by conductor material 50 are shown in heavy black lines while the remaining components are conventionally soldered to preamplifier section 68 with other portions conductor material 50 forming the interconnections conventional for a printed circuit board. Received signals pass through respective 180 degree delay lines 86 and 88, 90 degree hybrid combiner 89, and thence into low pass filter 90 which includes choke 92, resistor R1, capacitors C1, C2, and C3 and inductors L1 and L2. As shown in FIG. 12, components 92, C1–C3, and L1–2 are formed by the particular configuration of conductor material 50 as illustrated in more detail in FIG. 6. Resistor R1 is physically placed through substrate 44 from outboard face 46 as shown in FIG. 5.

Low pass filter 90 is coupled with preamplifier 41 by capacitor C4 (100 pF). Entering signals pass through a bias choke for input matching comprised of inductors L3 and L4 connected as shown. Signal preamplification is accomplished by the circuit composed of field effect transistor Q1 (type AT10136), capacitors C5 and C6, and resistor R2 all connected as shown.

An output matching network connected to the drain of Q1 includes inductors L5 And L6, resistor R3, and capacitor C7. The signal output from capacitor C7 is transmitted by way of 50 ohm transmission line 94 to connector assembly 32 having an RF choke connected thereto comprised of inductor L7 and capacitor C8. Constant bias is provided to transistor Q1 by the network composed of capacitors C9, C10, and C11, resistors R4, R5, R6, and R7, bipolar transistor Q2 (type MMB3906) and Zener diode Z1 (type MMBZ5234).

FIG. 7 illustrates the formation of signal receiving assembly 28. To accomplish this, flexible substrate 44 is rolled to form a tubularly shaped member which is held in formation at the upper end by crossover arm 36 soldered to diametrically opposed upper antenna elements 70 and 74, and by crossover arm 38 soldered to diametrically opposed upper antenna elements 72 and 76. Additionally, support disk 40 is soldered to soldering bands 96, 98, 100, and 102 formed from conductor material 50. In this position, support disk 40 defines a ground plane between the antenna elements and the other components which, in combination with shielding section 54, provides effective electromagnetic isolation. Finally, soldering bands 104 and 106 are overlapped and soldered in place.

Inspection of FIGS. 5 and 6 illustrate that preamplifier section 68 is separated by slot 109 along the upper edge thereof from antenna sections 52 and 64. This allows preamplifier section 68 to be creased along crease line 108 so that preamplifier section 68 remains planar and is maintained by support plate 42, as illustrated in FIG. 8.

FIGS. 7 and 11 illustrate that formation of substrate 44 into a tubular configuration has the effect of presenting the antenna elements into a helical configuration with the capacitive coupling of elements 56–62 and 70–76, four printed antenna filaments are created (hence quadrifilar).

As illustrated in FIGS. 8–11, elongated, tubular housing 30 includes housing portions 110, 112 which form housing 30. Housing portion 112 includes connector opening 114 and friction elements slot 116. Housing 30 provides the desired dielectric.

Connector 32 includes tubularly shaped knurled portion 118, signal coupler 120, washer 122, nut 124, friction element 126, spring 128, and cover 129. For assembly of antenna 14, signal receiving assembly 28 is placed within housing portion 112 with screw 130 securing support plate 42 and thereby preamplifier section 41 to housing portion number 110. The threaded end of coupler 120 is then placed through knurled portion 118 and connector opening 114, and held in place by washer 122 and nut 124 threadedly secured to coupler 120. Friction elements 126 is placed through slop 116 and held in biased position therethrough by spring 128, all as illustrated in FIG. 11. In the preferred embodiment use, the exposed end of coupler 120 plugs into signal processor 12 at connector 16 thereof. The friction between friction element 126 and knurled portion 118 holds antenna 18 after rotation to the desired position.

As those skilled in the art will appreciate from the above discussion, antenna 14 can be manufactured very economically while at the same time providing the high precision and sensitivity required for navigation. Additionally, the unique design of antenna 14 provides a sensitivity approximately 15 degrees below horizontal. With this increased capability, antenna 14 need not be held in a perfectly vertical position, but rather, can deviate as much as 15 degrees therefrom and still be sensitive to signals from satellites near the horizon hereof. This enhances the utility of navigator 10 and further increases the convenience when hand-held by user.

Having thus described the preferred embodiment of the present invention, the following is claimed as new and desired to be secured by Letters Patent:

1. An antenna for receiving navigation signals from a source thereof such as global position satellites, said antenna comprising:

a dielectric substrate presenting an elongated, tubular portion having inboard and outboard faces; and a plurality of elongated, helically configured, antenna filaments supported by said substrate, each of said antenna filaments including an upper antenna element supported on one of said faces and presenting a lower end, and including a lower antenna element supported on the other of said faces and presenting an upper end, said lower end of said upper antenna element being capacitively coupled through said substrate with said upper end of said lower element, further including a preamplifier circuit coupled with said antenna filaments for receiving signals therefrom and for amplifying said signals in order to produce antenna output signals, said substrate including a preamplifier section having additional conductive material printed thereon making up a portion of said preamplifier circuit, said tubular portion presenting a diameter, said preamplifier section of said substrate presenting a relatively flat configuration extending across a diameter of said tubular portion.

2. The antenna as set forth in claim 1, said dielectric substrate including PTFE.

3. The antenna as set forth in claim 1, further including circuit elements interconnecting said antenna filaments and said preamplifier circuit, said circuit elements including at least one of a delay line, a hybrid combiner, and a signal choke.

4. The antenna as set forth in claim 1, said antenna elements forming part of an antenna resonance loop, said capacitive coupling of said elements presenting an antenna feed at the fifty ohm point in said resonance loop.

5. A navigation unit for receiving and processing navigation signals from a source thereof such as global position satellites, said navigation unit comprising:

an antenna including a dielectric substrate presenting an elongated, tubular portion, a plurality of elongated, helically configured, antenna filaments supported by said substrate, a preamplifier circuit coupled with said antenna filaments for receiving signals therefrom and for amplifying said signals in order to produce antenna output signals, and a tubular housing enclosing said substrate, filaments and preamplifier circuit and including means for coupling with a signal processing unit for delivering said output thereto, said substrate including a preamplifier section having additional conductive material printed thereon making up a portion of said preamplifier circuit, said tubular portion presenting a diameter, said preamplifier section of said substrate presenting a relatively flat configuration extending across a diameter of said tubular portion, each of said antenna filaments including an upper antenna element supported on one of said faces and presenting a lower end, and including a lower antenna element supported on an opposed face and presenting an upper end, said lower end of said upper antenna element being capacitively coupled through said substrate with said upper end of said lower element; and a signal processing unit coupled with said antenna for receiving and processing said output signals.

6. The antenna as set forth in claim 5, said dielectric substrate including PTFE.

7. The antenna as set forth in claim 5, further including circuit elements interconnecting said antenna filaments and said preamplifier circuit, said circuit elements including at least one of a delay line, a hybrid combiner, and a signal choke.

8. The antenna as set forth in claim 5, said antenna elements forming part of an antenna resonance loop, said capacitive coupling of said elements presenting an antenna feed at the fifty Ohm point in said resonance loop.

* * * * *